United States Patent [19]

Keske et al.

[11] 4,406,257

[45] Sep. 27, 1983

[54] CAM ROLLER FOLLOWER

[75] Inventors: Frank E. Keske, Chillicothe; Alexander Goloff, East Peoria, both of Ill.

[73] Assignee: Caterpillar Tractor Co., Peoria, Ill.

[21] Appl. No.: 274,980

[22] Filed: Jun. 18, 1981

Related U.S. Application Data

[63] Continuation of Ser. No. 83,505, Mar. 19, 1979, abandoned.

[51] Int. Cl.[3] ..... F01L 1/16

[52] U.S. Cl. ..... 123/90.48; 123/90.5; 123/90.51

[58] Field of Search ..... 123/90.48, 90.50, 90.51; 29/156.7 B; 74/569

[56] References Cited

U.S. PATENT DOCUMENTS

| | | | |
|---|---|---|---|
| 992,089 | 5/1911 | Watt | 123/90.5 |
| 1,565,223 | 12/1925 | Church | 123/90.5 |
| 1,802,330 | 4/1931 | Boland | 123/90.5 |
| 3,089,472 | 5/1963 | Thompson | 123/90.5 |
| 3,291,107 | 12/1966 | Cornell | 123/90.51 |
| 4,173,954 | 11/1979 | Speckhart | 123/90.5 |
| 4,335,686 | 6/1982 | Clouse | 123/90.5 |

FOREIGN PATENT DOCUMENTS

| | | | |
|---|---|---|---|
| 2340074 | 2/1975 | Fed. Rep. of Germany | 123/90.48 |

*Primary Examiner*—Craig R. Feinberg
*Assistant Examiner*—W. R. Wolfe
*Attorney, Agent, or Firm*—Anthony N. Woloch

[57] ABSTRACT

Prior art roller followers have generally been relatively expensive to produce and provisions have had to be made to deliver pressurized lubricant to bushings which have been used as bearings for the roller. Such roller followers have also been made with partially open apertures for bearings, thus eliminating the need for pressurized lubrication, but in such roller followers there is a tendency for the rollers to fall out of the open apertures. These probelms are solved herein by forming the body (16) and bearing surfaces (26,28) of a roller follower (10) in two parts, an inner structure (20) which supports the bearing surfaces (26,28) and an outer structure (18) which surrounds the inner structure (20) and fastens the entire assembly (10) together. Preferably, the inner structure (20) comprises a pair of half tubular shells (22,24) which fit together and include flanges (40,41) for keeping the roller (12) in contact with the bearing surfaces (26,28). The principal use of such a roller follower (10) is in engines wherein the roller (12) contacts a camshaft and an end (44) of the roller follower removed from the roller (12) motivates a push rod against the force of a spring, thus causing the rod to reciprocate.

4 Claims, 6 Drawing Figures

CAM ROLLER FOLLOWER

This a continuation, of Ser. No. 83,505, filed Mar. 19, 1979, now abandoned.

DESCRIPTION

1. Technical Field

This invention relates to roller followers of the type utilizable with internal combustion engines. Such roller followers are particularly useful for transmitting the rotary motion of a camshaft into linear motion for a push rod.

2. Background Art

Roller followers are well known in the art for use with internal combustion engines. Generally, the roller of such structures is in contact with a camshaft, and, as the camshaft rotates the roller follower reciprocates within a bore in a block or the like. The end of the roller follower removed from the camshaft has means thereon for imparting its motion to a push rod which bears against a rocker arm to open an engine valve, which valve is conventionally spring biased against such motion, thus contributing to the reciprocal motion.

Generally, the prior art roller followers have been relatively expensive to manufacture since the roller portion thereof has generally had to use a relatively soft stationary and expensive pin, for example a bronze pin, thus increasing the expense of the apparatus, or, when stationary steel pins have been used, the bearings in the roller in which the pins have sat, have normally needed soft bushings, often bronze, thus again increasing the cost of the materials as well as the fabrication costs for such an apparatus. Still further, it has generally been necessary to provide means for delivering pressurized lubricant to the bushings so that the roller would turn sufficiently easily in use.

In one particular roller follower, specifically a roller follower as disclosed in U.S. Pat. No. 3,998,190 issued on Dec. 21, 1976 to Frank Edward Keske, the pin ends of the roller are not completely surrounded by the journaling apertures therefor, and, if the roller is positioned where oil splash will fall on the open portion of the pin ends, pressurized lubrication is not required. It is noted that the body of the roller follower of this patent is of a single piece construction, whereby either bushings must be utilized as bearing surfaces in the journaling apertures for the pin ends, or the entire body must be made of a material such as bronze or aluminum which has good bearing properties. However, if such a bearing material is utilized for the body of the roller follower, then when this body reciprocates within a steel bore in an engine block, it can be severely worn if the bore of the block is somewhat rough. Further, the journaling apertures cannot be open beyond a certain point if they are to retain the pin ends therein.

DISCLOSURE OF INVENTION

The present invention is directed to overcoming one or more of the problems as set forth above.

In one aspect of the present invention, an improvement is provided in a roller follower having a roller rotatably mounted on a bearing structure on a body structure. The improvement is attained when the body structure has an outer structure and an inner structure which is at least partially within the outer structure and wherein the bearing structure is supported by the inner structure.

Through operating in accordance with the present invention, a roller follower is provided which does not require pressurized lubrication of its bearings, and does not require bushings to serve as bearings. Further, by making the outer structure of a harder material than the inner structure, damage to the body structure does not occur when the roller follower reciprocates within a hard and somewhat rough bore in an engine block. In preferred embodiments, the roller is also prevented from falling out of the roller follower even if the apertures in which the ends of the roller sit are open 180° or more.

BEST MODE FOR CARRYING OUT THE INVENTION

While the following disclosure will be limited to discussing a roller follower for use with an internal combustion engine between a camshaft and a push rod, it should be understood that roller followers as taught herein find uses in other environments, and the invention is not meant to be limited to these specific described environments.

Figure 1:
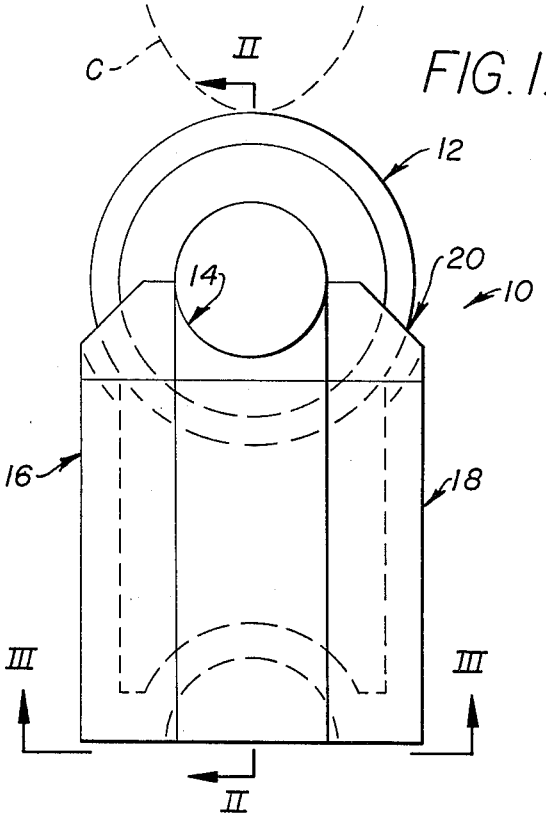
FIG. 1 illustrates, in side view, an embodiment of the present invention.

With reference to FIG. 1, an embodiment in accordance with the present invention will be described. The embodiment comprises a roller follower 10 having a roller 12 rotatably mounted on a bearing structure 14 which is mounted on a body structure 16. The body structure 16 is formed of an outer structure 18 and an inner structure 20 which is at least partially disposed within the outer structure 18. The bearing structure 14 is mounted on the inner structure 20.

Figure 2:
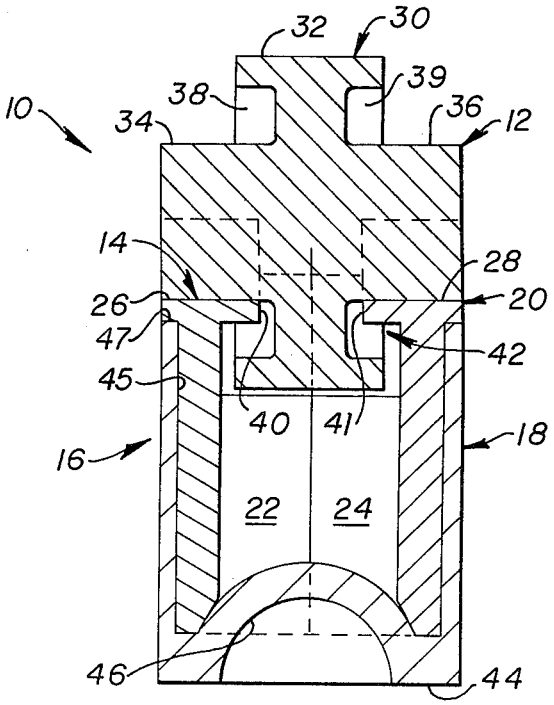
FIG. 2 illustrates a sectional view taken along the line II—II of FIG. 1.

As shown in FIG. 2, the inner structure 20 preferably includes a pair of inner members 22 and 24, with the inner member 22, which is generally in the form of a half tubular shell, and the inner member 24, which is also generally in the form of a half tubular shell, supporting bearing surfaces (journaling apertures), 26 and 28, respectively which together form the bearing structure 14. The inner structure 20 is generally made of a relatively soft bearing material, preferably aluminum. The outer structure 18 is generally made of a relatively hard abrasion resistant material different than the inner structure 20, such as steel, which can reciprocate in an equally hard bore in an engine block without damage. Thus, the inner structure 20 generally has a lesser hardness than does the outer structure 18. As will be most apparent from FIG. 1, the bearing structure 14 is generally open in a direction away from the body structure 16. Thus, at first glance it would seem that the roller 12 will simply fall out of the bearing structure 14. As will be pointed out, however, such is not the case.

Referring again to FIG. 2, it will be noted that the roller 12 has a generally central cylinder 30 having a roller surface 32. The roller 12 further has a pair of ends 34 and 36, of lesser diameter than the central cylinder 30, which extend axially from the cylinder 30 and into contact with the bearing surfaces 26 and 28 respectively. It should further be noted from FIG. 2 that the sum of the axial length of the cylinder 30 and both of the ends 34 and 36, is greater than the overall length of the roller 12. Basically, the roller surface 32 overhangs a portion of each of the ends 34 and 36 and defines a pair of annular channels 38 and 39, respectively, in the cylinder 30, which channels 38 and 39 open towards the respective ends 34 and 36. The respective bearing surfaces 26 and 28, extend at inner ends or flanges 40 and 41, respectively, into the respective channels 38 and 39. The entire structure thereby provides means 42 for maintaining the ends 34 and 36 of the roller 12 in contact with the bearing surfaces 26 and 28 when the inner members 22 and 24 are disposed together, such as when they are disposed at least partially within the outer structure 18.

Figure 3:
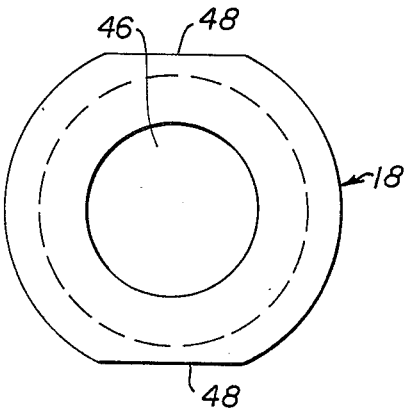
FIG. 3 illustrates a view taken along a line III—III of FIG. 1.
Figure 4:
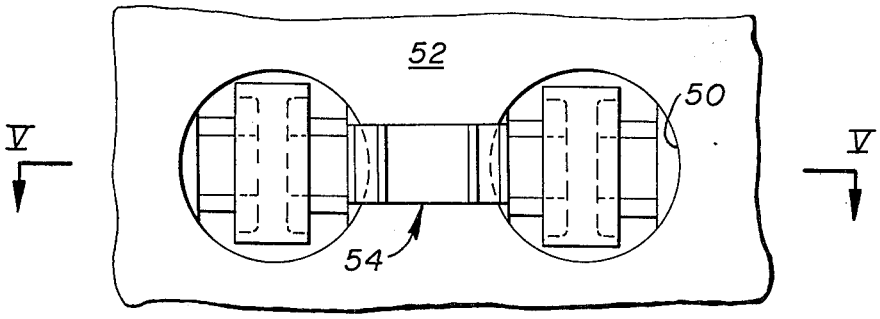
FIG. 4 illustrates in partial bottom view, the embodiment of the present invention shown in FIG. 1 in its use environment.

Turning now to a consideration of the outer structure 18, it will be noted that it is generally in the form of a sleeve closed at a first end 44 thereof and defining a cavity 45 extending therein from a second end 47 thereof, with the first end 44 having a socket 46 formed therein. Reference to FIG. 3 will make it clear that the sleeve 18 generally has one or more flats 48 provided thereon to prevent rotation of the outer structure 18, and thereby of the entire roller follower 10, within a bore 50 in a block 52 (see FIGS. 4 and 5). A spring clip 54 can be utilized in combination with the flats 48 to prevent such rotation. This assures that the roller 12 will be always properly aligned relative to a camshaft C, partially shown in phantom in FIG. 1. The outer structure 18 is generally made of a harder material than the inner structure 20, for example, the outer structure 18 is normally made of an iron alloy such as steel, whereby when the roller follower 10 reciprocates within the bore 50 in the block 52, the outer structure 18 is not badly worn thereby. Meanwhile, since the inner structure 20 is normally of a softer material, preferably aluminum, it provides good bearing surfaces 26 and 28 for the ends 34 and 36 of the roller 12.

Figure 3A:
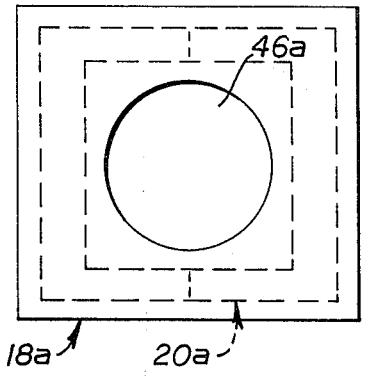
FIG. 3A illustrates a view similar to that of FIG. 3, but showing an alternate embodiment of the geometric construction of a roller follower in accordance with an embodiment of the present invention.

FIG. 3A illustrates an embodiment wherein an outer structure **18*a* and an inner structure 20*a* are rectangular in cross-section. A socket 46*a* would generally, however, have a similar configuration to the socket 46 of FIGS. 2, 3 and 5. Such a structure is useful when rectangular bores are formed within a block and eliminates the need for using a spring clip such as 54**.

INDUSTRIAL APPLICABILITY

Figure 5:
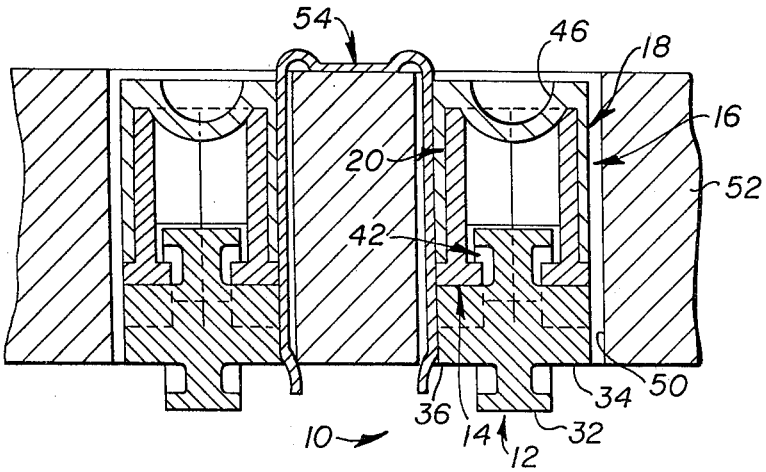
FIG. 5 illustrates a sectional view taken along the line V—V of FIG. 4.

The industrial applicability of the invention will perhaps be best understood by reference to FIG. 5. Briefly, the roller 12, or more particularly the roller surface 32 thereof, is placed in contact with a camshaft (which would run from left to right in FIG. 5 if shown therein). As the camshaft, C (shown in FIG. 1), rotates, a lobe thereof forces the roller follower 10 away from the center of the camshaft, C, (upwardly in FIG. 5). A push rod (not shown) is propelled by the socket 46, and a rocker arm spring, which acts against the other end of the push rod, provides a force downwardly on the push arm and thus on the roller follower 10 which, in combination with the action of the lobes of the camshaft, causes the roller follower 10 to reciprocate within the bore 50. Since the bearing structure 14 is exposed to the camshaft, i.e., since the bearing structure 14 is open away from the body structure 16, lubricant splashes up on the ends 34 and 36 of the roller 12 thus providing adequate lubrication thereto without the need for providing any pressurized lubricant flow thereto. The roller 12 cannot fall out of the roller follower 10, since the removal preventing means 42 prevents removal of the ends 34 and 36 of the roller 12 from the bearing structure 14. Since the material of the outer structure 18 of the body structure 16 is relatively hard, the roller follower 10 can reciprocate within the bore 50 without being unduly worn thereby. Since the inner structure 20 is made of a relatively soft material, it can serve as an excellent bearing structure 14. Thus, the bearing structure 14 does not require expensive bushings and the roller 12 can have a pin made of relatively inexpensive steel rather than brass or bronze.

Other aspects, objects, and advantages of this invention can be obtained from a study of the drawings, the disclosure, and the appended claims.

We claim:

1. In a roller follower (10) having a roller (12) rotatably mounted on a pair of bearing surfaces (26,28) which are mounted on a body structure (16), the improvement comprising:

said body structure (16) including an outer structure (18) and an inner structure (20) at least partially disposed within said outer structure (18);

said bearing surfaces (26,28) being on said inner structure (20) and being generally open in a direction away from said body structure (16);

said roller (12) having a generally central cylinder (30) having a roller surface (32) and a pair of ends (34,36) of lesser diameter than said roller surface (32) extending from said cylinder (30) into contact with said bearing surfaces (26,28) wherein the sum of the lengths of said cylinder (30) and both of said ends (34,36) is greater than the length of said roller (12), said roller surface (32) overhangs a portion of each of said ends (34,36) and defines a pair of annular channels (38,39) in said cylinder (30) opening towards said ends (34,36); and means (42) for maintaining said ends (34,36) in contact with said bearing surfaces (26,28) when said inner structure (20) is disposed at least partially within said outer structure (18) wherein said maintaining means (42) extends into at least one of said annular channels (38,39).

2. In a roller structure (10) having a roller (12) rotatably mounted on a pair of bearing surfaces (26,28) which are mounted on a body structure (16), the improvement comprising:

said body structure (16) including an outer structure (18) and an inner structure (20) at least partially disposed within said outer structure (18) wherein said outer structure (18) is a sleeve and said inner structure (20) is a pair of half tubular shells (22,24);

said bearing surfaces (26,28) being on said inner structure (20) and being generally open in a direction away from said body structure (16);

said roller (12) having a generally central cylinder (30) having a roller surface (32) and a pair of ends (34,36) of lesser diameter than said roller surface (32) extending axially from said cylinder (30) into contact with said bearing surfaces (26,28) wherein the sum of the lengths of said cylinder (30) and both of said ends (34,36) is greater than the length of said roller (12), said roller surface (32) overhangs a portion of each of said ends (34,36) and defines a pair of annular channels (38,39) in said cylinder (30) opening towards said ends (34,36); and means (42) for maintaining said ends (34,36) in contact with said bearing surfaces (26,28) when said half tubular shells (22,24) are disposed at least partially within said sleeve (18) wherein said maintaining means (42) is carried by at least one of said half tubular shells (22,24) and extends from said half tubular shell (22,24) into at least one of said annular channels (38,39).

3. In a roller follower (10) having a roller (12) rotatably mounted on a pair of bearing surfaces (26,28) which are mounted on a follower means (16), the improvement comprising:

said follower means (16) including an outer follower (18) and an inner follower (20) at least partially disposed within said outer follower (18);

said bearing surfaces (26,28) being on said inner follower (20) and being generally open in a direction away from said follower means (16);

said roller (12) having a generally central cylinder (30) having a roller surface (32) and a pair of ends (34,36) of lesser diameter than said roller surface (32) extending from said cylinder (30) into contact with said bearing surfaces (26,28) wherein the sum of the lengths of said cylinder (30) and both of said ends (34,36) is greater than the length of said roller (12), said roller surface (32) overhangs a portion of each of said ends (34,36) and defines a pair of annular channels (38,39) in said cylinder (30) opening towards said ends (34,36); and means (42) for maintaining said ends (34,36) in contact with said bearing surfaces (26,28) when said inner follower (20) is disposed at least partially within said outer follower (18) wherein said maintaining means (42) extends into at least one of said annular channels (38,39).

4. In a roller follower (10) having an outer follower (18) and an inner follower (20) at least partially disposed within said outer follower (18), said inner follower (20) having an inner flange (40,41) and a pair of bearing surfaces (26,28) generally open in a direction away from said outer follower (18), a roller (12) adapted to be rotatably mounted on said bearing surfaces (26,28) comprising:

a generally central cylinder (30) having a roller surface (32) and a pair of ends (34,36) of lesser diameter than said roller surface (32) extending from said central cylinder (30) and adapted to contact said bearing surfaces (26,28) wherein the sum of the axial lengths of said central cylinder (30) and both of said ends (34,36) is greater than the axial length of said roller (12), said roller surface (32) overhanging a portion of each of said ends (34,36) and defining a pair of annular channels (38,39) in said central cylinder (30) opening towards said ends (34,36) wherein at least one of said annular channels (38,39) is adapted to receive said inner flange (40,41) for confining a portion of the central cylinder (30) within said inner follower (20) when said inner follower (20) is disposed at least partially within said outer follower (18).

* * * * *